US007707694B2

(12) United States Patent
Holzer et al.

(10) Patent No.: US 7,707,694 B2
(45) Date of Patent: May 4, 2010

(54) POSITIONING MECHANISM FOR POSITIONING MEANS, IN PARTICULAR OF A SHOE

(75) Inventors: Helmut Holzer, Johann (AT); Gerhard Trinkaus, Köflach (AT); Jason Roe, Wagrain (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 820 days.

(21) Appl. No.: 11/436,776

(22) Filed: May 18, 2006

(65) Prior Publication Data

US 2006/0260101 A1 Nov. 23, 2006

(30) Foreign Application Priority Data

May 18, 2005 (AT) ..... A 846/2005

(51) Int. Cl.
*A43C 11/00* (2006.01)

(52) U.S. Cl. ..... 24/68 SK; 403/107; 403/324

(58) Field of Classification Search ..... 24/70 R, 24/70 SK, 69 SK, 68 SK, 71 SK, DIG. 47, 24/DIG. 48; 36/50.5; 403/109.3, 324, 107, 403/108

See application file for complete search history.

(56) References Cited

U.S. PATENT DOCUMENTS 2,688,504 A * 9/1954 Parker ..... 410/105
4,546,521 A * 10/1985 Ribarits ..... 24/70 SK
4,674,156 A * 6/1987 Olivieri ..... 24/71 SK
5,630,253 A * 5/1997 Benoit et al. ..... 24/70 SK

FOREIGN PATENT DOCUMENTS

EP 1 169 932 A2 1/2002

* cited by examiner

*Primary Examiner*—James R Brittain
(74) *Attorney, Agent, or Firm*—Collard & Roe, P.C.

(57) ABSTRACT

The invention relates to a positioning mechanism (1) for releasably fixing at least one position of a positioning means (3) which can be displaced more or less linearly relative to positioning means (2) fixedly connected to a structure (45), e.g. a shoe, which provides a mount for at least one displaceable coupling means (9) which engages under the action of a spring system (39) in a female coupling part (20) of the positioning means (2) connected to the structure (45) in a position which fixes the position of the positioning means (2, 3) relative to one another. The coupling means (9) is mounted in the displaceable positioning means (3) so that it can be linearly displaced in a direction perpendicular to the displacement direction of the positioning means (3) and, in a position fixing the position between the positioning means (2, 3), engages by means of a coupling projection (21) with the female coupling part (20) of the positioning means (2) connected to the structure (45) and in a positioning seat (42) disposed in the displaceable positioning means (3).

26 Claims, 8 Drawing Sheets

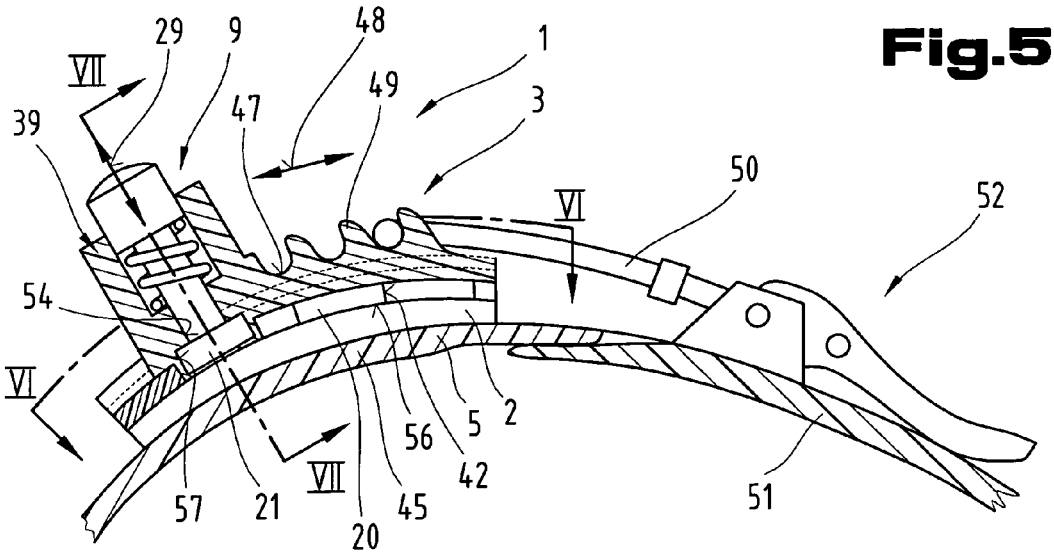
Fig.5
Fig.6
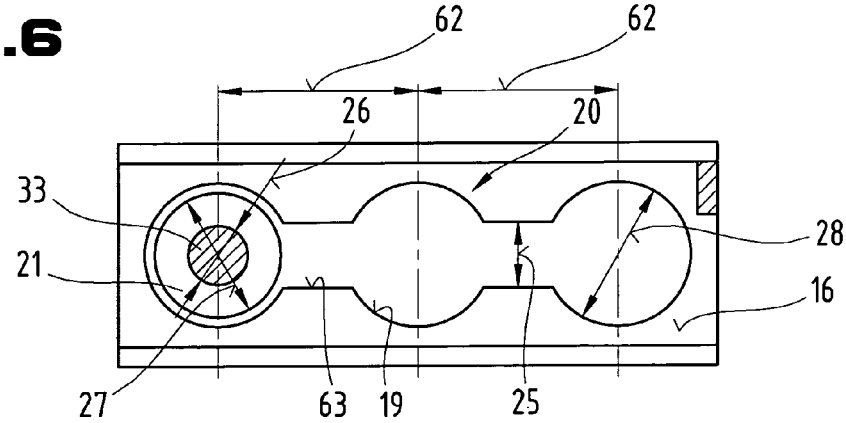
Fig.7
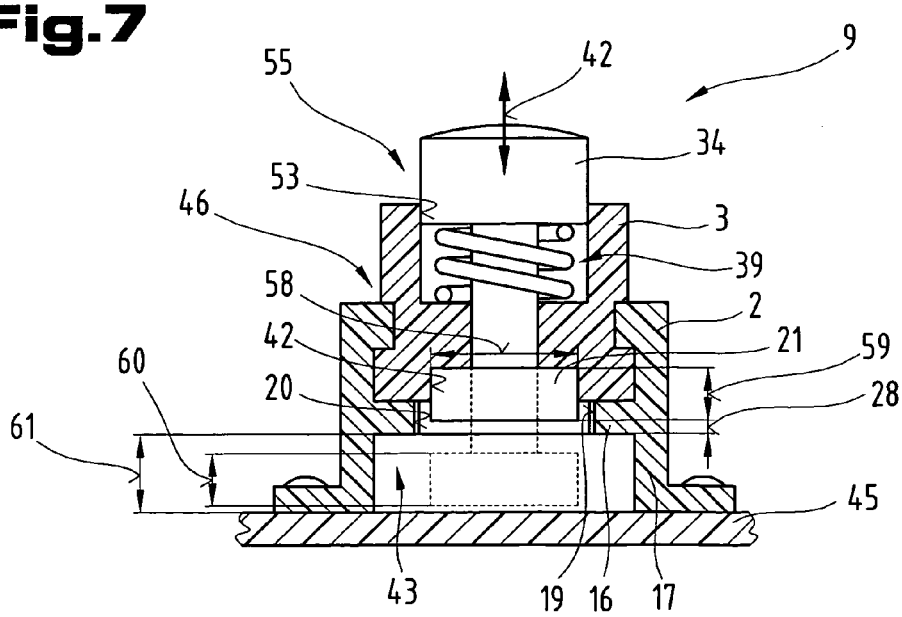

POSITIONING MECHANISM FOR POSITIONING MEANS, IN PARTICULAR OF A SHOE

CROSS REFERENCE TO RELATED APPLICATIONS

Applicant claims priority under 35 U.S.C. §119 of AUSTRIAN Patent Application No. A 846/2005 filed on May 18, 2005.

BACKGROUND OF THE INVENTION

1. Field of the Invention

The invention relates to a positioning mechanism for releasably fixing at least one position of a positioning means which can be displaced more or less linearly relative to a positioning means fixedly connected to a structure, for example a shoe, which provides a mount for at least one displaceable coupling means, which, under the action of a spring arrangement, engages in a female coupling part of the positioning means connected to the structure in a position which fixes the position of the positioning means relative to one another.

2. The Prior Art

Patent specification EP 1 169 932 A2 discloses a fixing means which can be positioned in several positions spaced apart from one another in the linear direction, in particular a shoe clasp for a sports shoe. A base plate is used to mount a bearing means in a linear guide system, which mounts a positioning means provided with a toothed contour on a top face. The bearing means is provided with a pivotable catch element in the form of a rocker, which, under the action of a spring, engages by means of catch projections in catch recesses provided in the base plate spaced apart from one another in the direction in which the bearing means is moved. By pivoting the rocker against the action of the spring about a pivot axis of the bearing means, the catch element can be disengaged from the catch recesses and the positioning element can therefore be moved in a linear direction relative to the base plate.

Another document, U.S. Pat. No. 4,674,156 A, discloses a clasp arrangement for a shoe, whereby a positioning element provided with a toothed contour on a top face is mounted so that it can be moved in a linear direction on a base plate secured to a region of the shoe. The base plate and the positioning element have mutually facing sets of support teeth which engage to fix a position. The positioning element is of a rocker-type design and is pivotable about an axis. The teeth are held in engagement by a spring-biasing action. When a force is applied to the rocker-type positioning element opposing the spring bias, the engagement is released in order to move the positioning element in a linear direction with respect to the base plate, thereby enabling a new position to be assumed.

Another document, U.S. Pat. No. 5,630,253 A, likewise discloses a positioning mechanism for a positioning means, in particular a shoe clasp. In this instance, a tooth element can be moved in a linear direction between two positions on a base plate attached to the shoe. The base plate has two circular orifices spaced at a distance part from one another in the linear direction, which are connected to one another by a slit. Facing the shoe interior and adapted to the cross-section of the orifices, a locking bolt is mounted in the tooth element so that it can rotate. Depending on the respective position of the locking bolt, a lock can be obtained in one of the two circular orifices due to flattened regions in the side of the cylindrical cross-section and the locking bolt can be pivoted by an angle of 90°, permitting two possible positions.

SUMMARY OF THE INVENTION

The objective of the invention is to propose a positioning mechanism for fixing at least one position between positioning means which can be linearly moved relative to one another, which is easy to operate and, being of the smallest possible construction, enables a reliable positioning action and is versatile in its application. This objective is achieved by the invention due to the fact that the connecting element is provided in the form of a link chain with a plurality of interconnected link parts, and the individual link parts are articulatingly connected to one another by means of several link connections forming several link axes oriented parallel with one another, and the link axes of the link connections are oriented essentially horizontally and extend transversely to the longitudinal extension of the connecting element and transversely to the binding longitudinal axis. The surprising advantage of this is that the positioning mechanism incorporating the specified features can be used to satisfy various demands in terms of function within the range of functions to be fulfilled, whilst requiring only slight modifications to the main components of the positioning mechanism.

Accordingly, one embodiment is possible whereby, in the locking position, the positioning means are disposed overlapping one another at least in certain regions on different structures, for example of a shoe shell and/or a shoe shaft of the shoe, which are displaceable relative to one another, as a result of which the positioning mechanism lends itself particularly well in terms of adaptability to various design requirements which are commonplace in the sports sector.

In another advantageous embodiment, one of the positioning means is attached to the structure and has a guide system in which the other positioning means is mounted so that it can be linearly displaced, resulting in a compact construction.

The fact that the positioning means is provided with several female coupling parts spaced at a distance apart from one anther results in an extended positioning range.

In another embodiment, the female coupling part is provided in the form of a circular orifice or bore, which, in terms of manufacturing, reduces the complexity involved in achieving a high positioning accuracy for key components.

Another option is to provide a cut-out in an end face of the positioning element with an insertion slit connecting it to the orifice, since this enables the positioning element and hence the structures to be rapidly and completely released.

In other advantageous embodiments, the coupling recess is provided in the form of a circular, rectangular or square cut or a bore in the positioning means and several of the coupling recesses are connected to one another by means of a connecting slit, thereby satisfying the requirements which have to be fulfilled for different intended purposes in different design variants.

The coupling means is of a bolt-type design and has a shaft and an operating button disposed on an end region of the shaft, and a coupling projection is provided at the opposite end region, which makes mass production economical whilst ensuring that the coupling means has the requisite strength even though it is small in terms of its dimensions.

In one embodiment, a height of the coupling projection corresponds more or less to a depth of the positioning seat plus an insertion depth of the coupling projection in the female coupling part so that the torque acting on the coupling means is kept low, which means that the coupling means can be made to a smaller dimension and its guide system in the positioning means can also be rendered simple.

Another option in this respect is for the height of the coupling projection to be smaller than a distance between a base web of the positioning means incorporating the female coupling part and the structure, in which case an appropriate space is left free for the coupling projection between the structure and the positioning means.

In other embodiments, the coupling projection is provided in the form of a circular coupling disc or a rectangular or square coupling plate, and the coupling projection is offset in a stepped shape in the vertical direction, thereby resulting in design variants which can be used in different applications of the positioning mechanism.

It is also of advantage if the positioning means secured to the structure is provided in the form of a C-shaped section, which is used to mount the other positioning means so that it can be displaced, because this results in an exact and reliable guiding action.

In other advantageous embodiments, the adjustable positioning means has two bolt-shaped coupling means in an axially aligned position which can be adjusted relative to one another and the coupling means are mounted so that they can be moved into bores of guide legs of the positioning means and/or the bores constitute the positioning seats and the female coupling parts are provided in the form of oppositely lying side legs of the positioning means extending parallel with the guide legs, and spaced apart bores are disposed in the direction in which the positioning means are displaced, and the coupling means are biased into an engaged position with the female coupling parts or the bores of the other positioning element by means of a clasp spring element disposed between them in a groove-shaped recess of the positioning element, thereby offering another different construction of the positioning mechanism proposed by the invention which enables a very close stagger between the positions of the positioning means.

Embodiments in which a spring force of the spring system acts between an annular surface of the operating head surrounding the shaft and a surface of the positioning means facing it or an annular contact surface of a bore provided in the positioning means partially accommodating the operating head ensure that the spring system is configured exactly for different requirements with regard to the adjustment of the coupling means.

In another option, one of the positioning means may be provided in the form of a toothed bar section with saw-tooth teeth, thereby enabling additional positioning points irrespective of how the positioning means are positioned relative to one another.

Advantage may also be had from other embodiments in which the coupling means is mounted so that it can be displaced in the releasing and a locking direction in a bore of a guide plate disposed on the positioning means and the guide plate is mounted on the positioning means so that it can be displaced in the direction perpendicular to the releasing and locking direction of the coupling means, enabling full and rapid release.

It is also of advantage if one of the positioning means is provided in the form of a rotary bearing, as a result of which the positioning mechanism can be used to effect a change of position in the region of mutually connected structures of the shoe which are rotatable, especially at the articulation point of the shoe shaft on the shoe shell, thereby enabling an angular position of the pivot axis to be varied by reference to the support surface of the shoe, thus permitting "canting" to compensate for anatomical aspects, for example an O or X leg position.

Finally, in other embodiments, the rotary bearing is provided in the form of a bearing bore disposed in the coupling means in the direction of the longitudinal extension and a bearing bolt mounted in it and constitutes the axis of rotation, and the coupling means can be displaced on the bearing bolt in the axial direction against the action of a compression spring, which means that standard components may be used for the positioning mechanism.

BRIEF DESCRIPTION OF THE DRAWINGS

To provide a clearer understanding, the invention will be explained in more detail with reference to examples of embodiments illustrated in the appended drawings. Of these:

FIG. 5 shows another embodiment of the positioning mechanism proposed by the invention, viewed in section along line V-V indicated in FIG. 7;

FIG. 6 shows the positioning mechanism in section along line VI-VI indicated in FIG. 5;

FIG. 7 shows the positioning mechanism in section along line VII-VII indicated in FIG. 5;

DETAILED DESCRIPTION OF PREFERRED EMBODIMENTS

Figure 1:
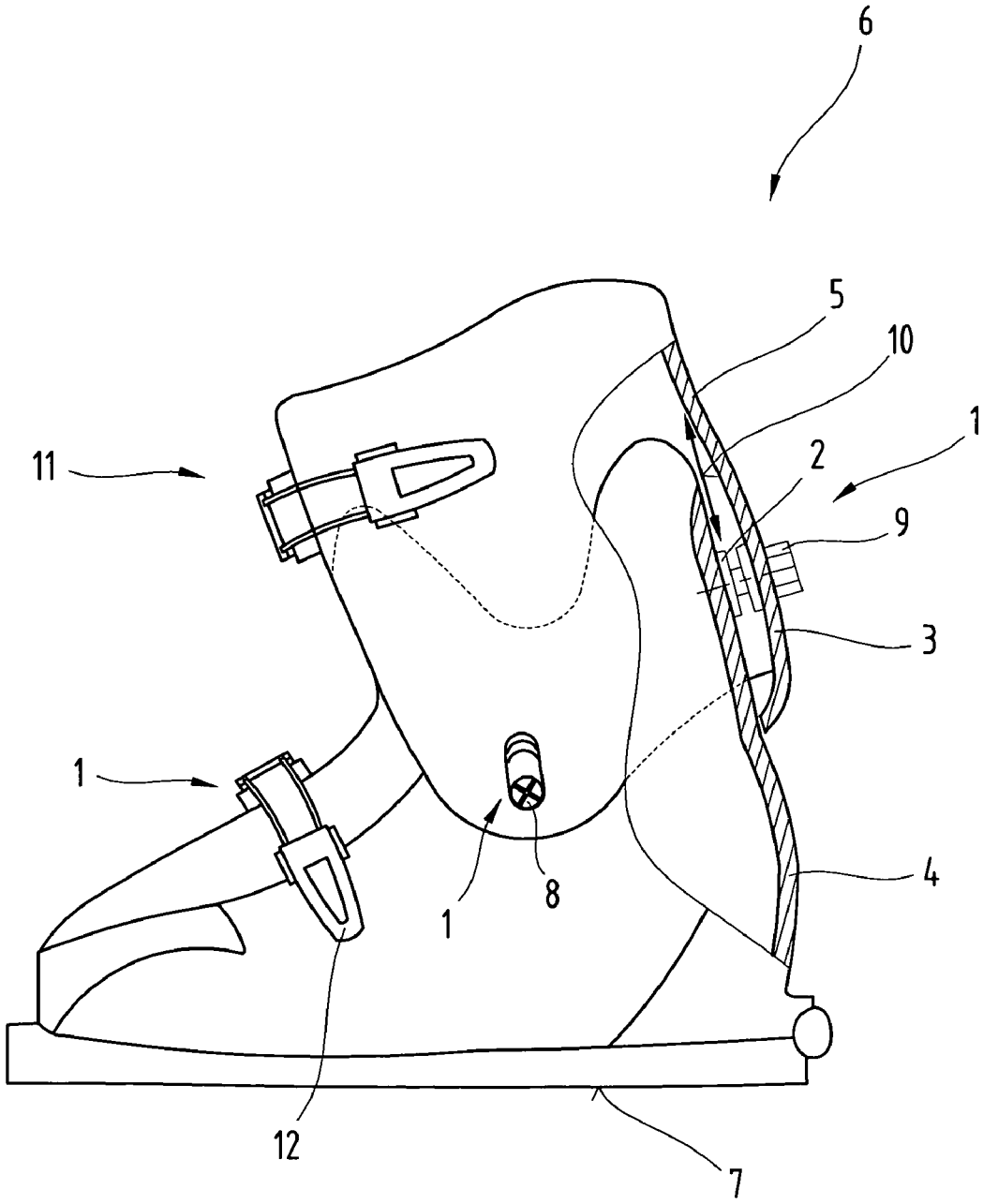
FIG. 1 shows a shoe with the positioning mechanism proposed by the invention disposed in different regions.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc,. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 illustrates a positioning mechanism 1 for releasably fixing two positioning means 2, 3 which can be displaced approximately linearly relative to one another in at least one position. The positioning means 2, 3 of the positioning mechanism 1 are secured to a structure of a shoe, preferably a sports shoe, such as a ski shoe or board shoe, for example, and one of the positioning means 2 is secured to a shoe shell 4 and the other positioning means 3 is secured, for example, to a shoe shaft 5 which moves relative to the shoe shell 4. A design of this type is used in particular with a ski shoe 6 or snowboard shoe or similar footwear because shoes of this type are provided with a shoe shaft 5 extending higher which is mounted on the shell structure as a separate shoe structure so that it can pivot about a pivot axis 8 extending more or less perpendicular to a support surface 7 and perpendicular to a longitudinal extension.

On this type of shoe 6, e.g. a ski or snowboard shoe, etc., it is necessary to provide a means of fixing the pivotable shoe shaft 5 on the one hand, but it must be possible to adjust to different positions on the other hand or also it must be possible for the fixing to be released in order to permit a so-called "FLEXING" during which a relative displacement between the structures is capable of opposing resistances caused merely by the material and design, which significantly enhances the comfort of this type of shoe 6 when worn.

These functions are made possible by the positioning mechanism 1 acting between the shoe shell 4 and the shoe shaft 5 more or less above a heel region, which is provided with a coupling means 9 by means of which a relative displacement—indicated by double arrow 10—between the positioning means 2, 3 and hence between the shoe shell 4 and the shoe shaft 5 is fixed and released.

In the embodiment illustrated as an example, the positioning mechanism 1 is designed to fix a position between the shoe shell 3 and the shoe shaft 4 for a predefined position or to release the ability to move relative to one another.

The positioning mechanism 1 is also designed so that the ability to move relatively basically causes no change in the relative position between the shoe shell 3 and shoe shaft 4.

As may also be seen from FIG. 1, the fastening means 11 for this type of shoe is provided in the form of a plurality of clasps 12 on the shoe shaft 3 and/or the shoe shell 4 with adjustment options in order to adapt the shoe to the shape of the foot on the one hand and adjust individual tension forces on the other hand. In the embodiment illustrated as an example, this objective is achieved using the positioning mechanism 1 on the clasp 12, as will be described in more detail below.

However, FIG. 1 illustrates yet another application of the positioning mechanism 1 in the region of the pivot axis 8 on which the shoe shaft 5 is mounted on the shoe shell 4 so that it can pivot. Accordingly, the positioning mechanism 1 is used to adjust the relative position between the pivot axis 8 and a thrust bearing of the shoe shaft 5 to permit what is referred to as "CANTING", i.e. by changing the relative position of the pivot axis 8, a lateral angular position can be imparted to the shoe shaft 5 with respect to the shoe shell 4 in order to compensate for anatomical deviations in the foot position. The positioning mechanism 1 in the region of the pivot bearing 8 will be described in more detail below.

Figure 2:
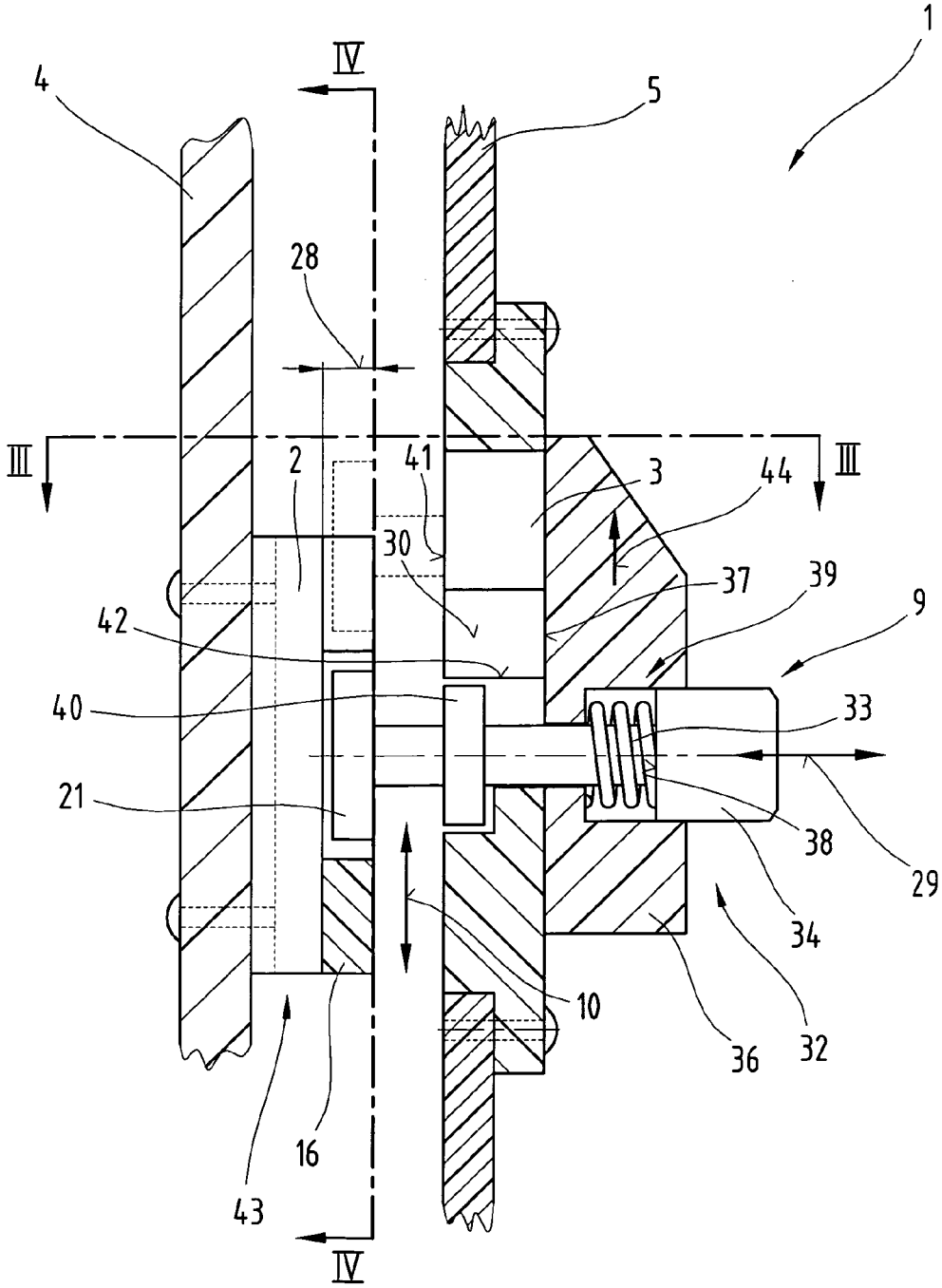
FIG. 2 shows the positioning mechanism proposed by the invention between the shoe shell and the shoe shaft, viewed in section.
Figure 3:
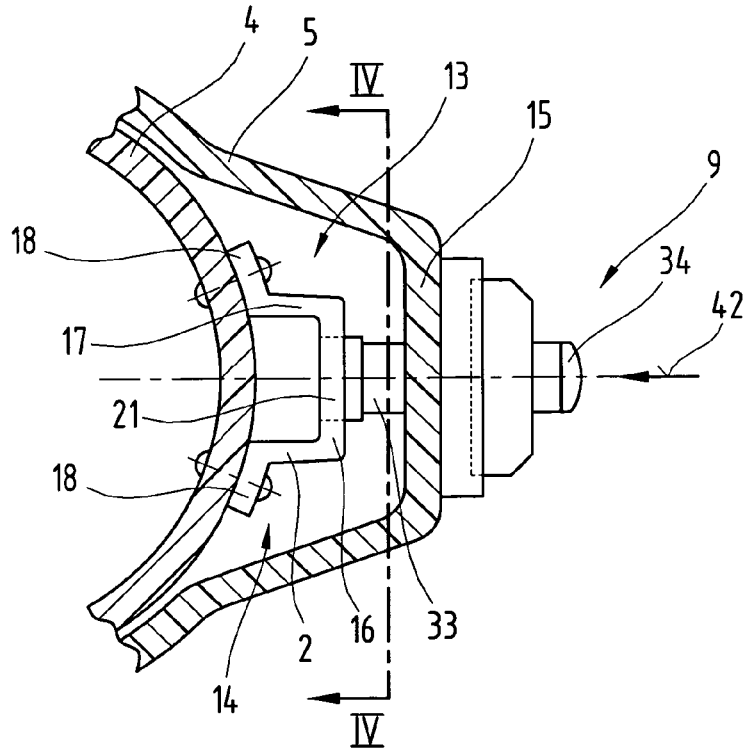
FIG. 3 shows the positioning mechanism in section along line III-III indicated in FIG. 2.
Figure 4:
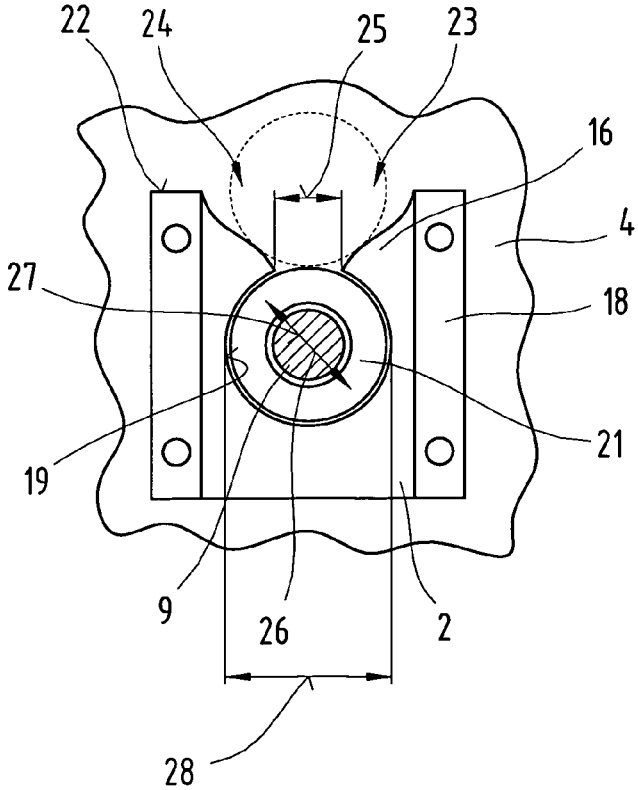
FIG. 4 shows the positioning mechanism in section along line IV-IV indicated in FIG. 3.

FIG. 2 to 4 provide detailed illustrations of the positioning mechanism 1 between the shoe shell 4 and the shoe shaft 5 based on a preferred embodiment.

In the area where the positioning mechanism 1 is disposed, an extended gap 13 is provided between the shoe shell 4 and the shoe shaft 5, formed by an outward bulge of the shoe shaft 5, affording an approximately U-shaped casing for accommodating the positioning means 2 secured to the shoe shaft.

The positioning means 2 is provided in the form of a section 14 with a U-shaped cross-section comprising a base web 16 facing a terminal wall 15 of the shoe shaft 5 and side legs 17 on either side, which form mounting flanges 18 for securing it to the shoe shell adapted to its contour and which are joined to the shoe shell 4 by rivets, for example.

Provided in the base web 16 as a female coupling part 20 is a circular orifice 19 in which a disc-shaped coupling projection 21 of the coupling means 9, provided in the form of an essentially bolt-type design, engages. A V-shaped cut-out 23 is also provided in the base web 16 between an upper end face 22 and the orifice 19. In the region of the orifice 19, an insertion slit 24 connects the cut-out 23 to the orifice 19. A width 25 of the insertion slit 24 is slightly bigger than a diameter 26 of a shaft region of the coupling means 9 and is approximately half as big as a diameter 27 of the disc-shaped coupling projection 21.

In the fixing position, the coupling projection 21 projects by an insertion depth 28 into the orifice 19, the diameter of which is slightly bigger than the diameter 27 of the coupling projection 21.

The coupling means 9 is mounted in the positioning means 3 secured to the terminal wall 15 lying opposite the positioning means 2, extending through it, so that it can be displaced—as indicated by double arrow 29. The positioning means 3 is penetrated by means of a slot 30 extending in the vertical direction. This also enables the coupling means 9 to be displaced in a direction—indicated by double arrow 31—perpendicular to the displacement direction—indicated by double arrow 29.

In an end region 32 projecting beyond the positioning means 3, the coupling means 9 has a cylindrical operating head 34 extending beyond the diameter 28 of a shaft 3, which projects into and slides in a bore 35 of a guide plate 36 mounted on the positioning means 3—as indicated by double arrow 31—in order guide the coupling means 9 axially.

The coupling means 9 is biased by means of a spring system 39, e.g. a spiral compression spring, curved plate spring, etc., on a surface 37 of the positioning means 3 and an annular surface 38 of the operating head 34 facing it, whilst a stop flange 40 extending out from the shaft 33 restricts the movement of the coupling means 9 due to an abutment on a rear face 41 of the positioning means 2.

In this position, the stop flange 40 sits in a positioning seat 42 provided in the positioning means 3, as a result of which the coupling means 9 is supported against the displacement forces which occur between the positioning means 2, 3.

Due to the effect of the spring system 39, when the coupling means 9 is in the non-operated position, the disc-shaped coupling projection 21 is positioned in the orifice 19 forming the female coupling part 20.

In order to release the resultant fixing, the coupling means 9 is displaced against the action of the spring system 39 by pressing on the operating head 34 in the direction of the shoe shell 4. As a result, the coupling projection 21 moves out of the female coupling part 20 into a free space 43 of the positioning means 2 disposed between the shoe shell 4 and the base web 16 and the flange 40 is moved out of engagement with the positioning seat 42. Consequently, another displacement of the coupling means 9 is possible with the guide plate 36—indicated by arrow 44. All in all, therefore, the coupling means 9 is moved from the region of the positioning means 2 via the insertion slit 23 into the position illustrated by broken lines in FIG. 4, thereby releasing the positioning action.

Due to the fact that the guide plate 36 bearing the coupling means is mounted so that it can move in the axial direction is able to move in a vertical direction relative to the positioning means 3—indicated by arrow 44—when the positioning mechanism 1 is unlocked, the relative position between the positioning means 2,3 and hence between the shoe shell 4 and the shoe shaft 5 does not change but provides the comfortable walking and standing function of the shoe 6.

In order to set a new position, it is necessary to overcome the spring force of the spring system 39 by pressing on the operating head 34 and pushing towards the bottom end position, after which, once the pressure on the operating head 34 has been lifted, the coupling projection 21 latches in the female coupling part 20 and the flange 40 latches in the positioning seat 42.

FIGS. 5 to 7 illustrate another embodiment of the positioning mechanism 1, disposed on a structure of the shoe 6. In the embodiment illustrated as an example here, the positioning mechanism 1 is used as a means of releasably fixing the relative position of the positioning means 2, 3, which can be displaced linearly with respect to one another, in at least two positions in order to adjust individual tension forces on the fastening means 11, e.g. the clasp 12 of the shoe 6.

The positioning means 2 is secured to a structure 45 of the shoe 6, for example a flap covering the step-in opening in the ankle region, so that it can not move, e.g. is screwed, riveted, bonded to it, and provides a mount for the positioning means 3, which is displaceable relative to it, in a linearly extending guide system 46. On a top face 47, the latter is provided with teeth 49 spaced apart in an adjustment direction—arrow 48—the tooth geometry of which is designed to accommodate a clamping clasp 50 of the clasp 12 made from a round material for example and prevent it from slipping. The clasp 12 is disposed on another structure 51 lying opposite the structure 45, for example the other flap, and is provided in the form of what might be termed a lever clasp 52, which provides a mount for the clamping clasp 50.

The displaceable positioning means 3 also has coupling means 9 mounted so as to be displaceable—as indicated by double arrow 29—in a direction perpendicular to the displacement direction—indicated by arrow 48—comprising the operating head 34, shaft 33 and coupling projection 21. In order to accommodate the coupling means 9 and its axial guide, a guide seat 55 is provided in the positioning means 3 in the form of stepped bores 53, 54.

Disposed on a bottom face 56 of the positioning means 3 in the region of the guide seat 55 is a countersunk bore 57 disposed coaxially with a longitudinal mid-axis 57 of the coupling means 9 serving as the positioning seat 42, which, when the female coupling part 20 of positioning means 2 is in the locked position, is positioned lying exactly opposite in the positioning means 3. A diameter 58 of the countersunk bore 57 is slightly bigger than the diameter 27 of the disc-shaped coupling projection 21. A depth 59 of the countersunk bore 57 more or less corresponds to half the height 60 of the coupling projection 21.

Consequently, in the position fixing the displacement, the coupling projection 21 engages both in the female coupling part 20 of the positioning means 2 and in the positioning seat 42 of the positioning means 3, which means that the insertion depth 28 likewise corresponds to approximately half of the height 60 of the coupling projection 21.

This design guarantees that the positioning elements 2, 3 are fixed in the intended position, thereby preventing a high torque on the coupling means 9, which would otherwise have to be absorbed by the guide seat 55 of the coupling means 9 in the positioning means 3.

The positioning means 2 secured to the structure 45 more or less has the shape of an elongate hat contour, with the base web 16 facing the positioning means 3 and with angled side legs 17 in the end regions, which space the base web 16 apart from the structure 45 to form the free space 43.

A distance 61 between the base web 16 and the structure 45 is slightly bigger than the height 60 of the coupling projection 11.

In the embodiment illustrated as an example here, three of the circular orifices 19 are provided as female coupling parts 20 at a distance 62 apart in the base web 16 of the positioning means 2 in the displacement direction of the positioning means 3, with a diameter 28 that is slightly bigger than the diameter 27 of the coupling projection 21.

The orifices 19 are linked by the connecting slit 63, which has a width 25 that is slightly bigger than the diameter 26 of the shaft 33 of the coupling means 9.

As is the case in the drawings described above, the coupling means 9 is biased in the operating direction by means of the spring system 39 in the direction opposite that needed for release purposes—indicated by arrow 42—and in this position the coupling projection 21 is in a position in which it engages both in the countersunk bore 57 of the positioning means 3 and in the orifice 19 and thus fixes one of the three possible positions, for example.

In order to release this fixing, it is necessary to move the coupling means 9 against the force of the spring system 39—indicated by arrow 42—in the direction of the structure 45 until the coupling projection 21 is in the region of the free space 43, as indicated by broken lines. This enables the positioning means 3 to be released and moved into one of the other positions, during which the shaft 33 of the coupling means 9 can be moved through the connecting slit 63.

With this embodiment of the positioning mechanism 1, since the positioning means 3 can be positioned in several positions relative to the positioning means 2, another adjustment option is possible due to the relative position between the positioning means 2, 3 in addition to the control which is possible by selecting a specific tooth 49 for hooking into the clamping clasp 50. This enables the relative position of the structures 45, 52 to be varied with respect to one another within a wide range so that the user of the shoe 6 can find the position which best suits him depending on the individual shape of the foot.

Figure 8:
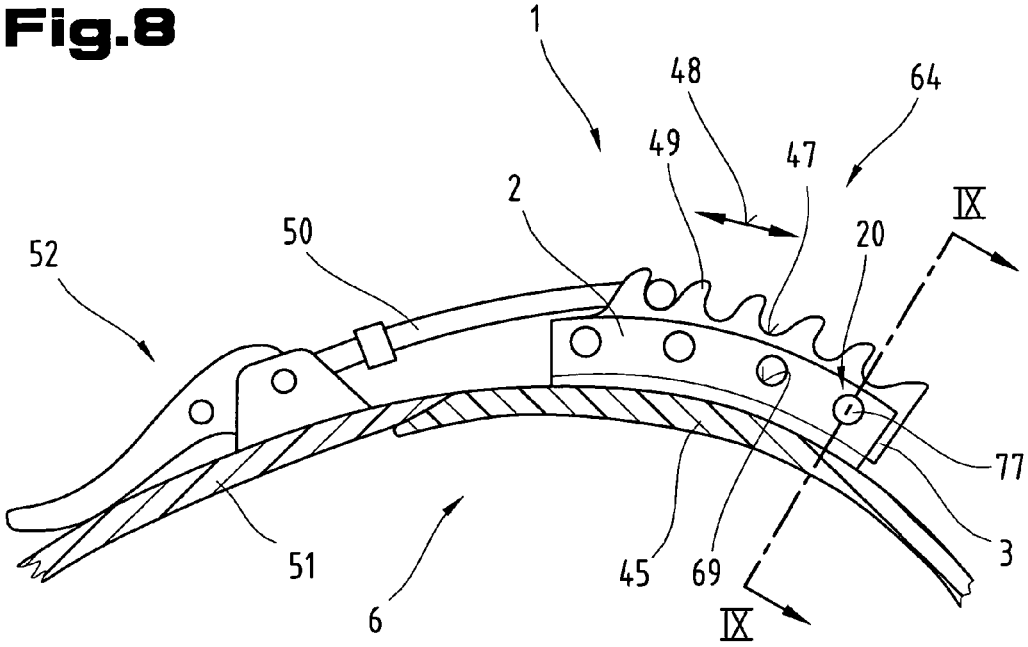
FIG. 8 is a front view showing another embodiment of the positioning mechanism.
Figure 9:
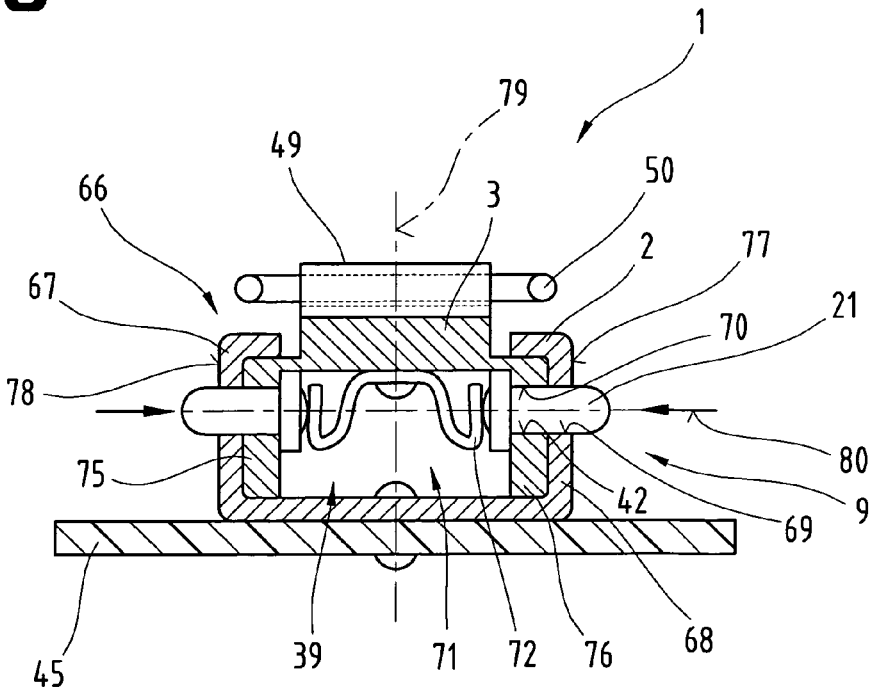
FIG. 9 shows the positioning mechanism in section along line IX-IX indicated in FIG. 8.

FIGS. 8 and 9 illustrate another embodiment of the positioning mechanism 1, comprising positioning means 2, 3 which can be displaced linearly with respect to one another, the relative position of which can be set to at least one position and released by means of at least one coupling means 9.

In the embodiment illustrated as an example, the positioning mechanism 1 is used as a means of adjusting the relative position of the structures 45, 52, as described in the case of the embodiment described as an example above with respect to the flaps of the step-in opening of the shoe 6. The positioning means 2 of the positioning mechanism 1 in which the positioning means 3, e.g. a toothed rack section 64, is mounted so that it can be displaced—as indicated by double arrow 48—is attached to the structure 45. The lever clasp 52 is disposed on the other structure 52. A clamp connection is produced between the lever clasp 52 and the toothed rack section 64 by means of the clamping clasp 50.

In the embodiment illustrated as an example, the positioning means 2 attached to the structure 45 is provided in the form of a C-shaped section 66, the contour of which forms the guide system 46 for the positioning means 3 which is mounted so that it can be displaced in the positioning means 2. Disposed in side legs 67, 68 of the section 66 are bores 69 spaced at a distance apart in the direction of the longitudinal extension, which constitute the female coupling parts 20 for mounting what in this specific example of an embodiment are two oppositely lying coupling means 9 which can be displaced in bores 70 of the positioning means 3, in the direction perpendicular to the displacement direction—indicated by arrow 48.

The positioning means 3 is provided on the top face 47 of teeth 49 spaced apart in the displacement direction—indicated by arrow 48—for hooking into the clamping clasp 50 and the structure 45 has a continuous groove 71 extending in the longitudinal direction, in which the spring system 39 provided in the form of a clasp spring element 72 is disposed. It is secured on a groove base 73 in the region of the oppositely lying coupling means 9 and is bent in a U-shape forming lateral resilient legs 74 for biasing coupling means 9 projecting into the groove 71.

The coupling means 9 comprise guide legs 75, 76 provided with a collar and extending through the bores 70 and, in the locking position, locking bolts 77 extending through the side legs 67, 68 of the positioning means 2 in the bores 69, biased by the clasp spring element 72 in the direction of the side legs 67, 68. In the latched state, they project beyond end faces 78 of the side legs 67, 68 and are of a rounded design in this region. However, the bores 70 in the guide legs 75, 76 also serve as positioning seats 42 for the locking bolts 77, as a result of which the displacement forces acting between the positioning means 2, 3 cause only a slight torque due to the fact that the distance of the forces is kept low.

In order to release the locked position to move the positioning means 3 into another desired position, the locking bolts 77 are moved by simultaneously pressing them against the action of the clasp spring element 72 in the direction of a longitudinal mid-plane 79—indicated by arrow 80—until they are aligned with the end faces 78 of the side legs 67, 68. Due to the rounded design in the end region, the positioning means 3 can be pushed—as indicated by arrow 48—because the rounded design causes a further flexing of the locking bolts 77 so that they can slide along an internal wall 81 of the side legs 67, 68 until they reach the new position. Due to the action of the clasp spring element 72, the locking bolts 77 automatically latch in the next position following the initial position. If a further adjustment is desired, the procedure described above is repeated.

Figure 10:
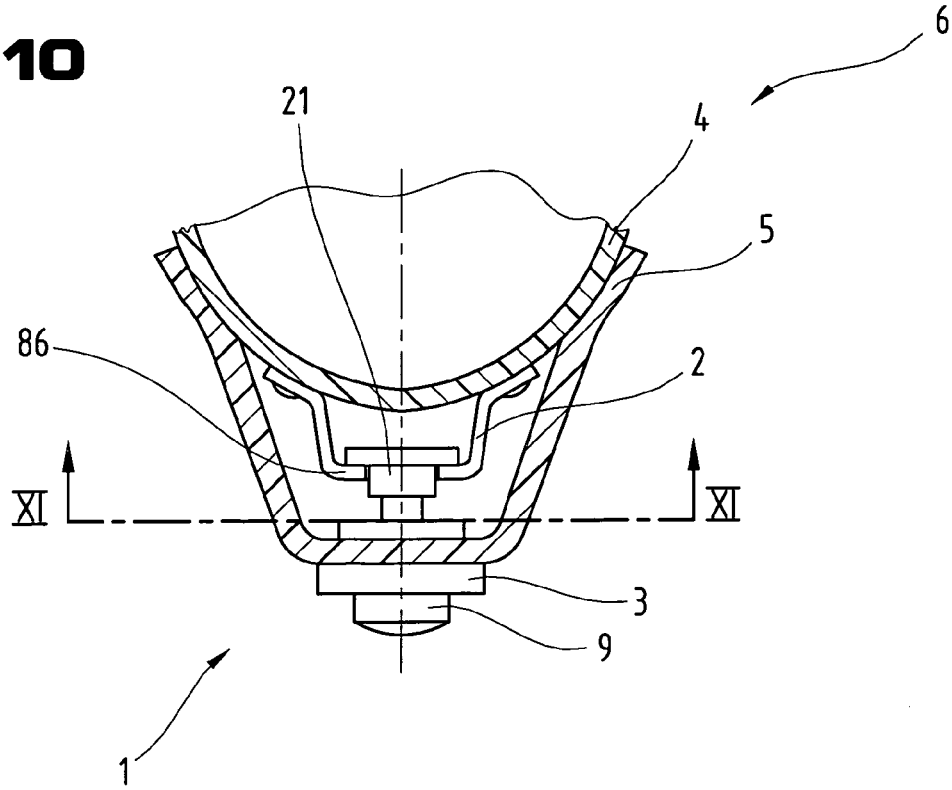
FIG. 10 shows another embodiment of the positioning mechanism proposed by the invention between the shoe shell and the shoe shaft, viewed in section along line X-X indicated in FIG. 11.
Figure 11:
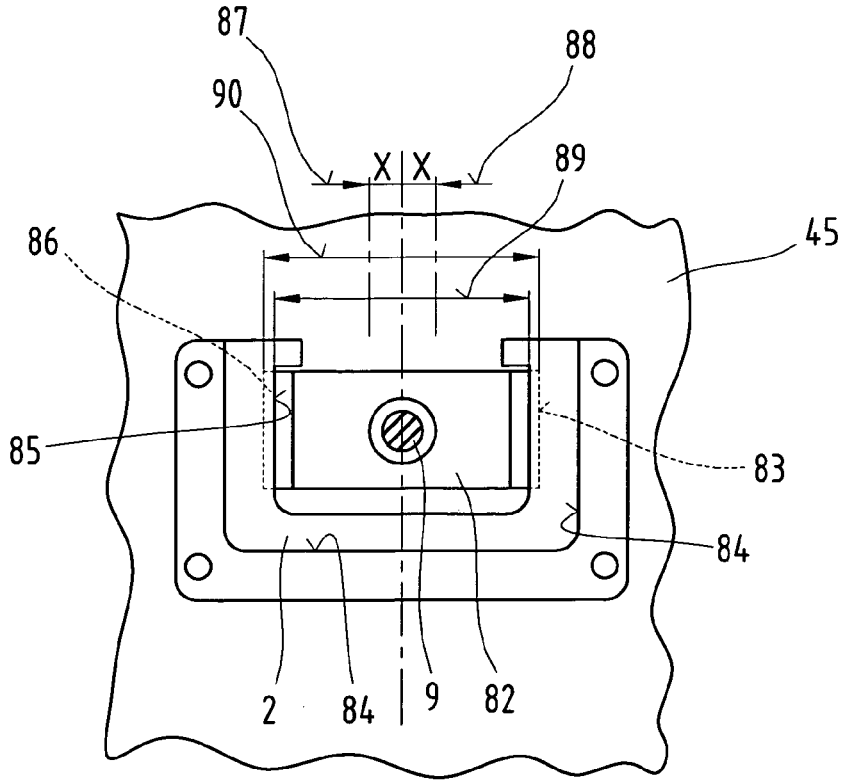
FIG. 11 shows the positioning mechanism in section along line XI-XI indicated in FIG. 10.

FIGS. 10 and 11 illustrate another embodiment of the positioning means 2 and the coupling means 9 incorporating the coupling projection 21 of the positioning mechanism 1 which is mounted so that can be moved into the other position, although this is not illustrated.

This embodiment enables positioning in a desired position, even if the position of the relatively positionable positioning means deviates laterally with respect to the positioning means 2 attached to the structure 45. This is specifically necessary for positioning the shoe shaft relative to the shoe shell whenever the shoe shaft assumes a lateral inclination relative to the shoe shell due to a so-called "canting" position such as often encountered in the case of ski shoes.

In this embodiment, a rectangular coupling projection 82 with stepped side edges 83 and a rectangular female coupling part 84 are provided. The female coupling part 84 has angled side edges 85, so that when the coupling projection 82 is engaged, it is positioned by legs 86 of the side edges 85 projecting towards one another in the female coupling part 84. A lateral clearance between the female coupling part 84 and the coupling projection 82 thus permits a lateral variance from a congruent center position of the positioning means 2, 3, indicated by arrows 87, 88—and the engagement in the female coupling part 84 is guaranteed due to the fact that the dimension of a width 89 is adapted to a total width 90 of the coupling plate 82. This embodiment therefore obviates the need to make positioning means 2, 3 specifically for such an application.

Generally speaking, it should be pointed out that the external shape of the positioning means 2, 3 can naturally be adapted to the specific intended application, i.e. both a flat and a curved external shape is possible.

There is also no restriction as regards the materials which may be used and these will depend on manufacturing and strength properties.

Figure 12:
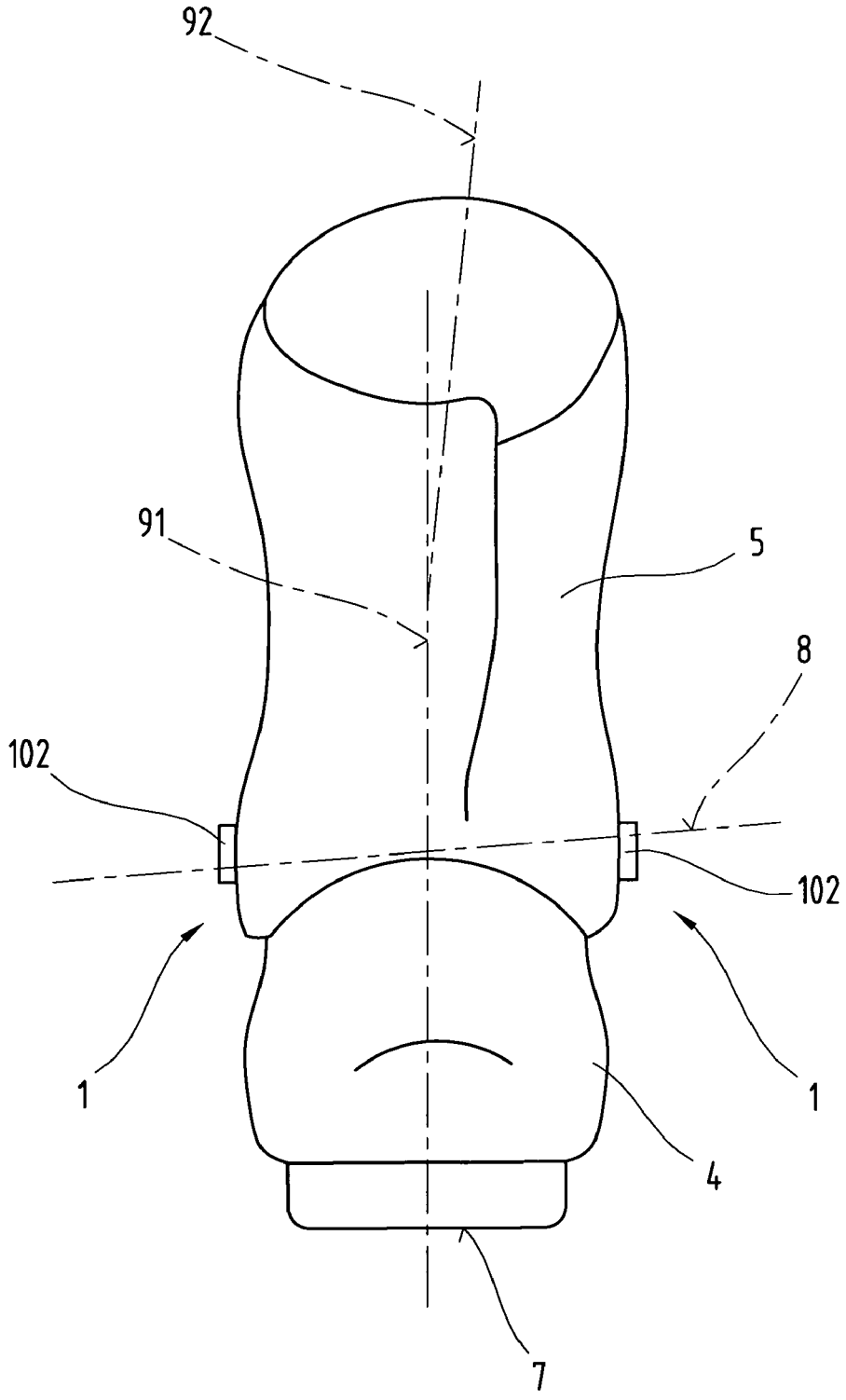
FIG. 12 shows another embodiment of the positioning mechanism in the region of the pivot bearing of the shoe shaft on the shoe shell.
Figure 13:
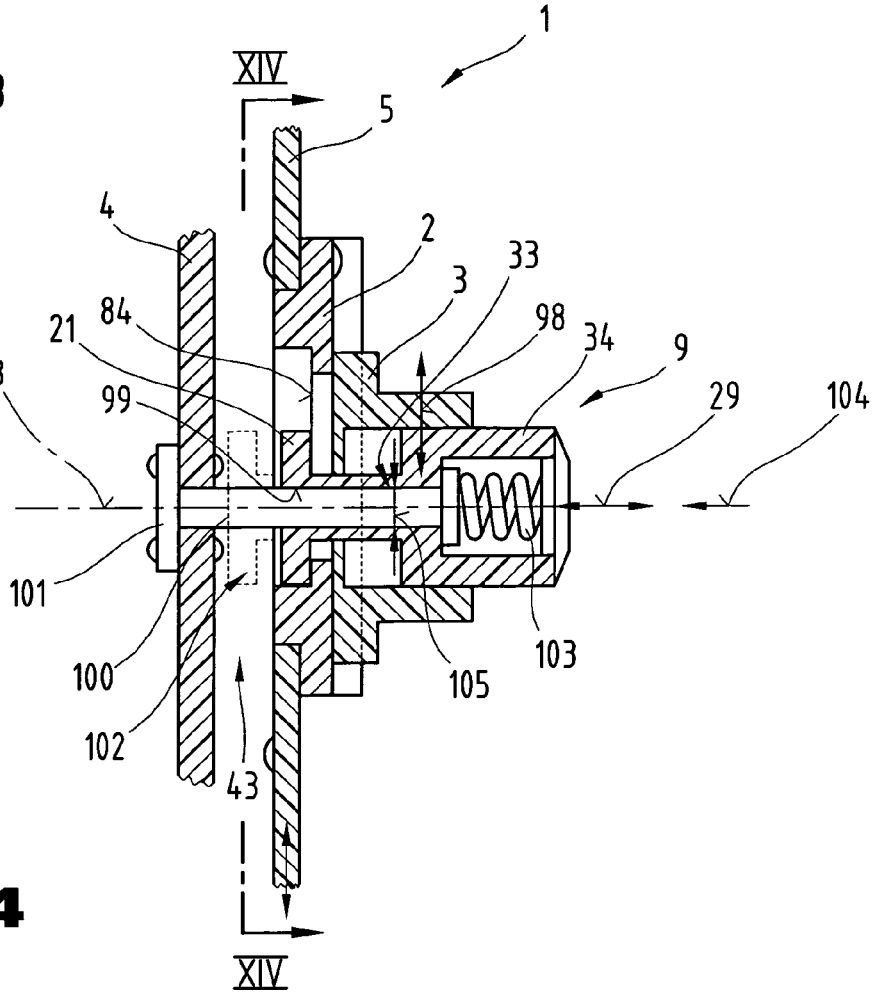
FIG. 13 shows the positioning mechanism in section along line XIII-XIII indicated in FIG. 14.
Figure 14:
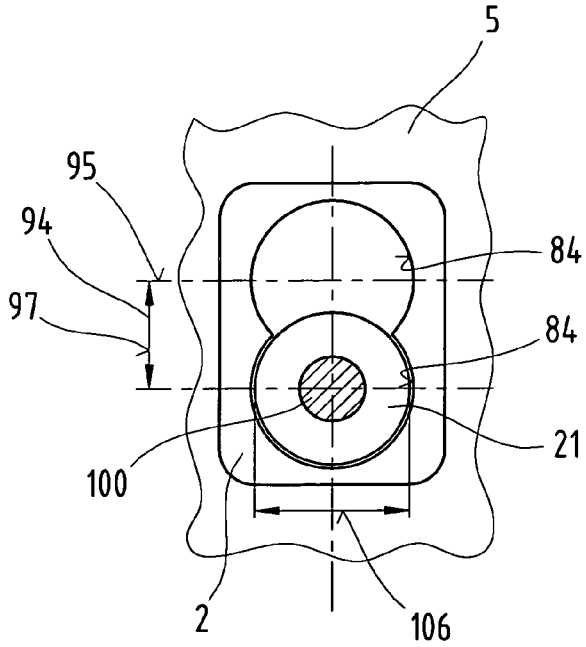
FIG. 14 shows the positioning mechanism in section along line XIV-XIV indicated in FIG. 13.

FIGS. 12 to 14 illustrate the positioning mechanism 1 for varying the relative position between the pivot axis 8 disposed on the shoe shell 4 and a thrust bearing 91 provided on the shoe shaft 5, whereby a lateral variance can be applied to the orientation of vertical axes 92, 93 of the shoe shaft 5 and the shoe shell 4. Furthermore, due to the fact that such bearing points forming the pivot axes 8 are provided on both sides of the shoe 6 for orienting the adjustment ranges of the positioning mechanisms 1, e.g. one in a horizontal orientation and the other in a vertical orientation extending perpendicular thereto, it is also possible, in addition to setting the lateral variance, to pivot the shoe shaft 5 about the vertical axis 92 depending on the pre-set positions determined by the positioning mechanism 1.

FIGS. 12 and 13 provide detailed illustrations of the situation in which the positioning mechanism 1 is used in the region of the pivot axis 8, which can be equated with the embodiments already described above and differs due to the fact that a smaller displacement path 94 between two positions 95, 96 of the positioning means 3 which can be displaced linearly with respect to the positioning means 2 is sufficient in this application. The positioning means 2 is attached to the shoe shaft 5 and has two circular female coupling parts 84 partially overlapping and a mid-distance 97 forms the displacement path 94. The positioning means 2, which is linearly displaceable—as indicated by double arrow 98—provides a mount for the positioning means 3, in which the coupling means 9 comprising the operating head 34, shaft 33 and coupling projection 21 is displaceable in the direction perpendicular to the displacement direction—as indicated by double arrow 29.

The coupling means 9 also has a bearing bore 99 into which projects a bearing bolt 100 constituting the pivot axis 8, which is attached to the shoe shell 4 by means of a head plate 101. This provides a rotary bearing 102 for the coupling means 9 and hence also for the positioning means 2, 3, whereby the positioning means 2 is connected to the shoe shaft 5. This enables the shoe shaft 5 to pivot relative to the shoe shell 4.

The movement of the coupling means 9 on the bearing bolt 100 in the direction of the shoe shell 4 in order to move the coupling projection 21 out of engagement with the female coupling part 84 and switch between the positions 95, 96, and hence also vary the relative position between the shoe shell 4 and shoe shaft 5 via the bearing bolt 100 of the rotary bearing 102, is effected against the action of a compression spring 103 disposed in the operating head 34 by pressing on the operating head 34,—as indicated by arrow 104. The coupling projection 21 thus moves into the free space 43 between the shoe shell 4 and the shoe shaft 5 so that the shaft 33 moves into the region of the female coupling parts 84. A diameter 105 of the shaft 33 is smaller than a slit width 106 in the transition region of the female coupling parts 84, thereby enabling the displacement between the positions 96, 97 and hence the displacement of the positioning means 3 with the coupling means 9 relative to and linearly with respect to the positioning means 2.

Due to the mounting of the bearing bolt 100 in the coupling means 9, however, the relative position between the shoe shell 4 and the shoe shaft 5 can also be varied depending on the positions 95, 96 pre-defined by the positioning mechanism 1, thereby achieving the "canting" which is often required with shoes of this type.

It should also be pointed out that, depending on how the positioning mechanism 1 is mounted and the orientation of the displacement direction between the positioning means 2, 3, a change in position can be obtained between the shoe shell 4 and shoe shaft 5 both in the vertical direction and in the horizontal direction, thereby permitting a rotary pivoting movement of the shoe shaft 5 relative to the shoe shell 4.

The embodiments illustrated as examples represent possible design variants of the positioning mechanism 1 and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the structure of the part-feeding system, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1; 2, 3, 4; 5, 6, 7; 8, 9; 10, 11; 12, 13, 14 constitute independent solutions proposed by the invention in their own right. The objectives and associated solutions proposed by the invention may be found in the detailed descriptions of these drawings.

LIST OF REFERENCE NUMBERS

1. Positioning mechanism
2. Positioning means
3. Positioning means
4. Shoe shell
5. Shoe shaft
6. Shoe
7. Support surface
8. Pivot axis
9. Coupling means
10. Double arrow
11. Fastening means
12. Clasp
13. Gap
14. Section
15. Terminal wall
16. Base web
17. Side leg
18. Mounting flange
19. Orifice
20. Female coupling part
21. Coupling projection
22. Support surface
23. Cut-out
24. Insertion slit
25. Width
26. Diameter
27. Diameter
28. Insertion depth
29. Double arrow
30. Slot
31. Double arrow
32. End region
33. Shaft
34. Operating head
35. Bore
36. Guide plate
37. Surface
38. Annular surface
39. Spring system
40. Stop flange
41. Rear face
42. Positioning seat
43. Free space
44. Arrow
45. Structure
46. Guide system
47. Top face
48. Arrow
49. Tooth
50. Clamping clasp
51. Structure
52. Lever clasp
53. Bore
54. Bore
55. Guide seat
56. Bottom face
57. Countersunk bore
58. Diameter
59. Depth
60. Height
61. Distance
62. Distance
63. Connecting slit
64. Toothed rack section
65.
66. Section
67. Side leg
68. Side leg
69. Bore
70. Bore
71. Groove
72. Clasp spring element
73. Groove base
74. Resilient leg
75. Guide leg
76. Guide leg
77. Locking bolt
78. End face
79. Longitudinal mid-axis
80. Arrow
81. Internal wall
82. Coupling projection
83. Side edge
84. Female coupling part
85. Side edge
86. Leg
87. Arrow
88. Arrow
89. Width
90. Total width
91. Thrust bearing
92. Vertical axis
93. Vertical axis

94. Displacement
95. Position
96. Position
97. Mid-distance
98. Double arrow
99. Bearing bore
100. Bearing bolt
101. Head plate
102. Rotary bearing
103. Compression spring
104. Arrow
105. Diameter
106. Slit width

What is claimed is:

1. Positioning mechanism for releasably fixing at least one position of a positioning means which can be displaced more or less linearly with respect to a positioning means fixedly connected to a structure, which provides a mount for at least one displaceable coupling means which engages under the action of a spring system in a female coupling part of the positioning means connected to the structure in a position which fixes the position of the positioning means relative to one another, wherein the coupling means is mounted in the displaceable positioning means so that it can be linearly displaced in a direction perpendicular to the displacement direction of the positioning means and, in a position fixing the position between the positioning means, engages by means of a coupling projection with the female coupling part of the positioning means connected to the structure and in a positioning seat disposed in the displaceable positioning means.

2. Positioning mechanism according to claim 1, wherein, in the locking position, at least certain regions of the positioning means are disposed overlapping with one another on different structures which can be displaced relative to one another.

3. Positioning mechanism according to claim 2, wherein one of the positioning means is attached to the structure and has a guide system in which the other positioning means is mounted so as to be linearly displaceable.

4. Positioning mechanism according to claim 3, wherein the displaceable positioning means has two bolt-type coupling means which can be displaced relative to one another in an axially aligned position.

5. Positioning mechanism according to claim 4, wherein the coupling means are displaceably mounted in bores of guide legs of the positioning means and form the positioning seats.

6. Positioning mechanism according to claim 1, wherein the female coupling parts are provided in the form of bores spaced apart from one another in the displacement direction of the positioning means in oppositely lying side legs of the positioning means extending parallel with the guide legs.

7. Positioning mechanism according to claim 1, wherein the female coupling part are provided in the positioning means, disposed at a distance apart from one another in the displacement direction.

8. Positioning mechanism according to claim 7, wherein several of the female coupling parts are connected to one another by means of a connecting slit.

9. Positioning mechanism according to claim 1, wherein the female coupling part is provided in the form of a circular orifice or a bore.

10. Positioning mechanism according to claim 1, wherein a cut-out is provided in an end face of the positioning element with an insertion slit connecting it to the orifice.

11. Positioning mechanism according to claim 1, wherein the female coupling part is provided in the form of a circular, rectangular or square cut-out or a bore in the positioning means.

12. Positioning mechanism according to claim 1, wherein the coupling means is of a bolt-type design and comprises a shaft and an operating head disposed at one end region of the shaft and the coupling projection disposed at the opposite end region.

13. Positioning mechanism according to claim 12, wherein a height of the coupling projection more or less corresponds to a depth of the positioning seat plus an insertion depth of the coupling projection in the female coupling part.

14. Positioning mechanism according to claim 13, wherein the height of the coupling projection is shorter than a distance between a base web of the positioning means incorporating the female coupling part and the structure.

15. Positioning mechanism according to claim 12, wherein the coupling projection is provided in the form of a circular coupling disc.

16. Positioning mechanism according to claim 12, wherein the coupling projection is provided in the form of a rectangular or square coupling plate.

17. Positioning mechanism according to claim 12, wherein the coupling projection is offset in a stepped shape in the direction of the height.

18. Positioning mechanism according to claim 1, wherein the positioning means attached to the structure is provided in the form of a C-shaped section which displaceably mounts the other positioning means.

19. Positioning mechanism according to claim 1, wherein the coupling means are biased by means of a clasp spring element disposed between them in a groove-shaped cut-out of the positioning element into an engaged position with the female coupling parts or the bores of the other positioning element.

20. Positioning mechanism according to claim 19, wherein a spring force of the spring system acts between an annular surface of the operating head surrounding the shaft and a surface of the positioning means facing it or an annular contact surface of a bore partially accommodating the operating head in the positioning means.

21. Positioning mechanism according to claim 1, wherein one of the positioning means is provided in the form of a toothed rack section with teeth of a saw-tooth design.

22. Positioning mechanism according to claim 1, wherein the coupling means is mounted in a bore of a guide plate disposed on the positioning means so as to be displaceable in the releasing and locking direction.

23. Positioning mechanism according to claim 22, wherein the guide plate is mounted on the positioning means so as to be displaceable in a direction perpendicular to the releasing and locking direction of the coupling means.

24. Positioning mechanism according to claim 1, wherein one of the positioning means constitutes a rotary bearing.

25. Positioning mechanism according to claim 24, wherein the rotary bearing is provided in the form of a bearing bore disposed in the coupling means in the direction of the longitudinal axis and a bearing bolt constituting the axis of rotation mounted in it.

26. Positioning mechanism according to claim 25, wherein the coupling means is displaceable on the bearing bolt in the axial direction against the action of a compression spring.

* * * * *

UNITED STATES PATENT AND TRADEMARK OFFICE

CERTIFICATE OF CORRECTION

PATENT NO. : 7,707,694 B2
APPLICATION NO. : 11/436776
DATED : May 4, 2010
INVENTOR(S) : H. Holzer et al.

It is certified that error appears in the above-identified patent and that said Letters Patent is hereby corrected as shown below:

In Column 13, line 53, please change "the female coupling part" to correctly read: --several female coupling parts--.

Signed and Sealed this

Fifteenth Day of June, 2010

David J. Kappos

David J. Kappos
*Director of the United States Patent and Trademark Office*